US011993550B2

(12) United States Patent
Feustel et al.

(10) Patent No.: US 11,993,550 B2
(45) Date of Patent: May 28, 2024

(54) WATER RESISTANCE ADDITIVE FOR PARTICULATE AMMONIUM NITRATE-FUEL OIL (ANFO) EXPLOSIVES

(71) Applicant: Clariant International Ltd., Muttenz (CH)

(72) Inventors: Michael Feustel, Köngernheim (DE); Matthias Krull, Harxheim (DE); Ian James Tolliday, Victoria (AU); Christopher Robin Collins, Victoria (AU); Maja Franjic, Victoria (AU); Thomas Roy, Bochum (DE)

(73) Assignee: CLARIANT INTERNATIONAL LTD, Muttenz (CH)

( * ) Notice: Subject to any disclaimer, the term of this patent is extended or adjusted under 35 U.S.C. 154(b) by 841 days.

(21) Appl. No.: 16/093,609

(22) PCT Filed: Mar. 13, 2017

(86) PCT No.: PCT/EP2017/055769

§ 371 (c)(1),
(2) Date: Oct. 12, 2018

(87) PCT Pub. No.: WO2017/186400

PCT Pub. Date: Nov. 2, 2017

(65) Prior Publication Data

US 2019/0071372 A1 Mar. 7, 2019

(30) Foreign Application Priority Data

Apr. 27, 2016 (EP) ..... 16167343

(51) Int. Cl.
*C06B 23/00* (2006.01)
*C06B 31/28* (2006.01)

(52) U.S. Cl.
CPC ..... *C06B 23/009* (2013.01); *C06B 23/001* (2013.01); *C06B 31/285* (2013.01)

(58) Field of Classification Search
None
See application file for complete search history.

(56) References Cited

U.S. PATENT DOCUMENTS 2,541,389 A 2/1951 Taylor
4,736,683 A * 4/1988 Bachman ..... C06B 31/285 102/290
6,539,870 B1 4/2003 Granholm
2005/0003984 A1 1/2005 Himmrich
2005/0155682 A1* 7/2005 Ogata ..... C06B 47/145 149/61
2006/0019835 A1 1/2006 Kayser
2010/0278763 A1 11/2010 Loeffler
2011/0110878 A1 5/2011 Knappe
2013/0140871 A1 6/2013 Fedorov
2014/0086854 A1 3/2014 Klug
2019/0071372 A1 3/2019 Feustel

FOREIGN PATENT DOCUMENTS

| | | |
|---|---|---|
| CN | 105111033 | 12/2015 |
| EP | 0256669 | 2/1988 |
| EP | 0276934 | 8/1988 |
| EP | 0750899 | 1/1997 |
| EP | 0816403 | 1/1998 |
| EP | 3239120 | 11/2017 |
| EP | 3448832 | 3/2019 |
| GB | 397600 A | 8/1933 |
| JP | 2001089285 | 4/2001 |
| JP | 2002029877 | 1/2002 |
| JP | 2005255504 | 9/2005 |
| JP | 4111436 | 7/2008 |
| WO | 9800094 | 1/1998 |
| WO | 2012084977 | 6/2012 |
| WO | 2017186400 | 11/2017 |

OTHER PUBLICATIONS

English Translation of JP2005-255504, Sep. 22, 2005, 12 pages.
Machine translation of JP2002029877, Jan. 29, 2002, 9 pages.
Proceedings of the 6th. General ISEE, Annual Conference, Tampa, FL, Jun. 28, 2000 by Fred C. Drury, Executive Vice President, ECONIX Incorporated, Wheaton, Illinois. 13 pages.
Ullmanns Encyclopadie der Technischen Chemie, 5th edition, vol. A 21, pp. 305 to 413, 1985.
Takuya Taguchi, et al., Sci. Tech. Energetic Materials, 66 (2005), pp. 393-397.

* cited by examiner

*Primary Examiner* — Aileen B Felton

(57) ABSTRACT

The present invention provides for the use of at least one oil soluble polymer comprising linear polymethylene sequences with an average of 10 to 40 consecutive methylene groups to improve the water resistance of an explosive composition comprising particulate ammonium nitrate and a fuel oil, said linear polymethylene sequences with in average 10 to 40 consecutive methylene groups may be either in the main chain or in the side chains of the oil soluble polymer.

33 Claims, No Drawings

WATER RESISTANCE ADDITIVE FOR PARTICULATE AMMONIUM NITRATE-FUEL OIL (ANFO) EXPLOSIVES

This invention pertains to a fuel-soluble or fuel-dispersible, hydrophobic water-repelling additive which can be added to particulate ammonium nitrate-fuel oil (ANFO) explosive mixtures to impart water resistance.

The current state of the art about ANFO is described in "Ammonium nitrate blasting agents from manufacture to field use", Proceedings of the 6th. General ISEE, Annual Conference, Tampa, FL, Jun. 28, 2000 by Fred C. Drury, Executive Vice President, ECONIX Incorporated, Wheaton, Illinois.

Ammonium nitrate is often used as an effective and cost-efficient mining explosive, mainly in emulsion-type explosives, in slurry-type explosives or in a mixture with fuel oil.

Emulsion-type explosives are water-in-oil dispersions comprising a continuous phase of fuel and an internal liquid phase of ammonium nitrate and/or other nitrates (oxidizer) in water. Emulsion-type explosives are viscous liquids. Typically they contain 73 to 76 wt.-% of ammonium nitrate and 18 to 20 wt.-% of water, the balance being essentially fuel oil and have a density of 1.30-1.35 kg/l. The hydrophobic continuous phase gives the emulsion some inherent water resistance. The intimate contact between the oxidizer in the emulsion droplets and the fuel in the continuous phase results in a higher velocity of detonation than ANFO type explosives. Specialized emulsifiers are required to stabilize emulsion explosives. The disadvantages of emulsion explosives are that they are more difficult to manufacture than ANFO, have a shorter shelf-life than ANFO, are generally more expensive and the emulsions need to be sensitized before they can be used.

Slurry explosives, also known as water-gel explosives are suspensions of a solid component in a continuous semi-solid or gel phase. These explosives consist essentially of a water solution of an inorganic oxidizer such as ammonium nitrate or mixtures of ammonium nitrate with sodium or calcium nitrate, the continuous aqueous phase being thickened, respectively gelled, by Guar gum or other high-molecular weight, water soluble organic polymers. Additional crystalline oxidizer and fuel is suspended in the gel matrix providing a relatively large amount of oxidizer surrounded by a small amount of fuel. Slurry explosives have an acceptable water resistance and give a high velocity of detonation. However, slurry explosives are relatively difficult to manufacture and are generally expensive.

Ammonium Nitrate—Fuel Oil mixtures (ANFO) have been in use since 1955. This type of explosive mixture has the advantage of being the most inexpensive variant. Blasting costs using ANFO are typically from one-half to one-third of the cost compared to emulsion, slurry explosives and even cartridged explosives. ANFO is also relatively easy to manufacture, being a mixture of fuel oil and blasting-grade prilled ammonium nitrate (oxidizer) where the prills typically constitute around 94% of the mixture. ANFO is comprised of free flowing solid particles which can be readily poured, augered or pneumatically pumped into bore holes. In contrast to emulsion type explosives they do not have to be sensitized before use. The preferred modification of ammonium nitrate applied in explosive applications is low-density ammonium nitrate (LDAN). The high porosity of the LDAN allows for a good oil absorption necessary for optimal blasting energy yield. ANFO explosives, in contrast to emulsion and slurry explosives, are substantially free of water, i.e. they contain less than 2 wt.-%, most often less than 1.0 wt.-% and especially less than 0.5% of water.

The major disadvantage of ANFO is that it has very poor water resistance. Water is readily absorbed by the ANFO mixture resulting in poor detonation or failure to detonate. Even small amounts of water can radically reduce performance. The primary effect is the water replacing the air between the prills and the air sites in the porous prill which reduces or eliminates sites for adiabatic compression which are essential for propagation of detonation. In more extreme cases where a lot of water is present, the ammonium nitrate will start dissolving resulting in poor detonation or no detonation at all.

In order to use ANFO in wet boreholes, the boreholes either have to be dewatered first or a physical barrier such as a plastic borehole liner or waterproof packaging needs to be used. These methods are labor intensive and add a substantial amount of cost to the blasting.

Some ANFO products with allegedly improved water resistance (WR-ANFO) are available on the market. The majority of these products utilize a dry water-resistant coating over the ammonium nitrate prills which retards water penetration. These WR-ANFO compositions typically use high percentages of cross-linked guar gums for coating to improve the water resistance of the ANFO prills. In these compositions the guar gum swells to form a barrier upon contact with water and then cross-links. The guar gum component has no inherent water-repelling ability and is extremely hydrophilic. Often large amounts of water are absorbed into the explosive before the protective barrier is established. This often results in desensitization and poor detonation.

Often polymers are used in the formulation of emulsion and slurry explosives. In the case of slurry explosives, water soluble polymers with high molecular weights are applied in order to increase the viscosity of the aqueous phase. The application of oil soluble polymers to improve the properties of explosives and especially to improve the properties of ANFO is scarce.

EP-A-256669 teaches improved dry ammonium nitrate blasting agents comprising particulate high density ammonium nitrate in admixture with a liquid carbonaceous fuel, characterized by the presence of a high molecular weight polymer having a high stringiness factor, for example poly (isobutylene). The high molecular weight polymer provides improved fuel retention of the fuel on the particles and thereby improved explosive storage properties. These explosives permit the use of high density ammonium nitrate prills in preparing such improved dry blasting agents. Such higher density particles allow the generation of higher explosion velocities, as compared to porous, low density ammonium nitrate particles of equivalent particle size. The reference teaches that prior art ANFO explosives made with high density prills have not been stable to fuel oil drainage over extended time periods, whereas the disclosed explosives can be stored for up to 2 weeks, and even longer, without substantial, detrimental drainage of the fuel oil from the particles. No mention of the water resistance of such ANFO explosives is made.

U.S. Pat. No. 2,541,389 is directed to ammonia dynamites which, in addition to normally non-cohesive dynamite ingredients, also include a viscous liquid polybutene product, such as polybutene having Staudinger molecular weights of between 40,000 and about 120,000. The resulting mixture is a cohesive dynamite product.

JP 2002029877 A discloses water-proof granular explosives comprising ammonium nitrate porous prills and fuel oil, and the ammonium nitrate prills are coated with polymer which is in liquid state by heat-melting or emulsion state and solidifies after covering the prills.

EP-A-0276934 teaches emulsion explosive compositions comprising a discontinuous phase comprising at least one oxygen-releasing salt; a continuous organic phase; an emulsifying agent; and at least one polymer soluble in the organic phase and wherein the polymer comprises associative functional groups. The associative functional groups are polar groups capable of entering into specific association with other associative groups, e.g. a copolymer of tert.-butyl styrene and 4-vinyl pyridine (97:3 by weight). This leads to the formation of highly elastic emulsion explosive compositions which may be loaded into wet boreholes without prior dewatering of the borehole. By mixing such emulsion with solid ANFO the emulsion may coat the ANFO and protect the granules from water to some extent. In these highly viscous liquid mixtures, the water resistance is solely due to the presence of the emulsion. However, the blending of emulsion with ANFO requires further specialized equipment. So, EP-A-0276934 does not provide a solution how to improve the water resistance of an ANFO being in the form of free flowing solid particles.

US-2013140871 relates to ammonium nitrate fuel oil mixtures, and includes compositions comprising (a) ammonium nitrate, (b) a fuel component, (c) a functionalized polymer component, and (d) an oil-soluble anionic surfactant, wherein the mixture of components (b), (c) and (d) form a gel that will not readily flow. These compositions are reported to provide improve fuel retention and/or water resistance properties, particularly when the compositions use low quality porous prills of ammonium nitrate.

JP 2001 089285 teaches an ammonium nitrate explosive comprising a surface coating of the powdered or granulated ammonium nitrate with a wax having a melting point of 60 degrees C. or more to impart water repellence to the explosive.

The problem to be solved by the instant invention was to find means to improve the still unsatisfactory water resistance of ANFO and especially the water resistance of low density ammonium nitrate fuel oil mixtures (LDANFO). In particular the reliability of ANFO and especially of LDANFO to detonate even after storage in moist and especially in wet environment as it is often found in blast holes was to be improved. The oil soluble high molecular weight polymers disclosed in the state of the art improve the fuel oil retention time on the ammonium nitrate particles. It is reported that this is at least in part due to the autoadhesion property of the polymers ("stringiness" of the polymers) which is more or less exclusively limited to the surface of the ammonium nitrate prills. However, as soon as water penetrates this film the ammonium nitrate inside the prills will become wet and/or dissolved. Therefore the polymers of the state of the art do not have a profound effect on water resistance. Furthermore, manufacture of the WR-ANFO should be possible at lower temperatures where handling of the neat fuel oil becomes difficult due to rise of viscosity and/or precipitation of paraffins.

Surprisingly it has been found that the application of certain groups of oil soluble synthetic polymers with low viscosity, inter alia polymers made from ethylene and other ethylenically unsaturated compounds as well as comb polymers with defined side chain lengths, provide water resistance to low density ammonium nitrate-fuel oil mixtures (LDANFO). They preserve the LDANFO's capability to detonate even after storage in damp/wet surrounding. Without being bound to this theory, it is believed that oil soluble polymers with low molecular weights and a certain amount of polar groups close to the polymer backbone penetrate the ammonium nitrate prills together with the fuel oil and thereby improve the water repellency also inside the prills.

In a first aspect, the instant invention provides for the use of at least one oil soluble polymer comprising linear polymethylene sequences with an average of 10 to 40 consecutive methylene groups to improve the water resistance of a particulate explosive composition comprising particulate ammonium nitrate and a fuel oil, said linear polymethylene sequences with in average 10 to 40 consecutive methylene groups may be either in the main chain (meaning the backbone) or in the side chains of the oil soluble polymer.

In a second aspect, the instant invention relates to a process for improving water resistance of particulate ammonium nitrate fuel oil explosives, the method comprising the step of adding to the explosive composition comprising particulate ammonium nitrate a fuel oil containing an oil soluble polymer comprising linear polymethylene sequences with an average of 10 to 40 consecutive methylene groups, said linear polymethylene sequences with in average 10 to 40 consecutive methylene groups may be either in the main chain (backbone) or in the side chains of the oil soluble polymer.

In a third aspect, the invention provides a process for manufacturing of water resistant particulate ammonium nitrate fuel oil explosives that can be used according to the first aspect of the invention comprising bringing a particulate ammonium nitrate into contact with a fuel oil, the fuel oil being the solution and/or dispersion of an oil soluble polymer comprising linear polymethylene sequences with an average of 10 to 40 consecutive methylene groups, said linear polymethylene sequences with in average 10 to 40 consecutive methylene groups may be either in the main chain or in the side chains of the oil soluble polymer.

In a fourth aspect the invention provides a water resistant, particulate, low density ammonium nitrate fuel oil explosive, comprising particulate ammonium nitrate, a fuel oil and an oil soluble polymer comprising linear polymethylene sequences with an average of 10 to 40 consecutive methylene groups, said linear polymethylene sequences with in average 10 to 40 consecutive methylene groups may be either in the main chain or in the side chains of the oil soluble polymer, wherein the ammonium nitrate has a bulk density of between 0.60 to 0.90 g/cm$^3$, the bulk density being determined by weighing an untamped sample of the ammonium nitrate in a container of known volume.

In the following the preferred embodiments of the invention will be described with respect to the use aspect of the invention. The preferred embodiments are likewise applicable to the other aspects of the invention, in particular to the process for improving water resistance of particulate ammonium nitrate fuel oil explosives, to the process for manufacturing of WR-ANFO especially at low temperatures and to the particulate, low density ammonium nitrate fuel oil explosive.

The water resistance as meant herein is measured as the mass portion of ANFO remaining after a given time, as for example after 24, 48 or 72 hours of exposure of solid ANFO to a water saturated substrate. Water resistance is considered to be satisfactory when a defined threshold of ANFO of preferably at least 50 wt.-%, more preferably 75 to 99 wt.-% and especially 90 to 98 wt.-% as for example 75 wt.-% or more, 90 wt.-% or more, 50 to 99 wt.-%, 50 to 98 wt.-%, 75 to 98 wt.-% or 90 to 99 wt.-% of the ANFO is recovered after the given time. This value reflects the minimum quantity of ANFO required for a successful detonation.

In the water resistance test, ANFO samples are prepared using an oxidizer/fuel ratio of preferably 94:6 by weight. The water resistance additives, if any, are preferably applied as part of the fuel component.

The oil soluble polymers suitable for the use as well as for the processes of the invention are preferably substantially chemically non-reactive with the ammonium nitrate under the temperature conditions in which the ammonium nitrate is contacted with fuel oil/polymer mixture.

The polymers with an average of 10 to 40 consecutive methylene groups suitable for the use as well as for the processes of the invention preferably have a drop melting point below 60° C., more preferred below 55° C., as for example determined according to ASTM D127.

In a preferred embodiment, the oil soluble and water insoluble polymers are those which are commonly used to improve at least one cold flow property of mineral oils, and especially of mineral fuel oils. Such cold flow properties may be the cloud point, the wax appearance temperature, the pour point and/or the cold filter plugging point. In this respect improvement typically means a reduction of the temperature at which the respective phenomenon occurs. Especially preferred oil soluble polymers comprising linear polymethylene sequences with an average of 10 to 40 consecutive methylene groups, said linear polymethylene sequences with in average 10 to 40 consecutive methylene groups being either in the main chain (backbone) or in the side chains of the oil soluble polymer are i) copolymers of ethylene with 5 to 18 mol-% of at least one monomer selected from vinyl esters, esters of ethylenically unsaturated monocarboxylic acids and vinyl ethers having a $C_1$ to $C_8$ alkyl or alkenyl group,
ii) homo- and copolymers of esters, amides and/or imides of ethylenically unsaturated carboxylic acids, said esters, amides and/or imides bearing alkyl residues with an average alkyl chain length of $C_{10}$-$C_{40}$, and
iii) graft polymers of homo- and copolymers of esters, amides and/or imides of ethylenically unsaturated carboxylic acids, said esters, amides and/or imides bearing alkyl radicals with an average alkyl chain length of $C_{10}$-$C_{40}$ on copolymers of ethylene with 5 to 18 mol-% of at least one monomer selected from vinyl esters, esters of ethylenically unsaturated carboxylic acids and vinyl ethers having a $C_1$ to $C_8$ alkyl or alkenyl group.

In the following, the aforementioned three classes of polymers may be referred to as copolymer i), copolymer ii), and copolymer iii).

If the oil soluble polymers are ethylene copolymers the polymethylene sequences are in the main chain. In case the polymers do not contain ethylene the polymethylene sequences are in the side chains of the polymers. Oil soluble means that the polymers are soluble in aliphatic and/or aromatic solvents like toluene, xylene, aromatic naphtha, heavy aromatic naphtha, kerosene, diesel fuel, decaline or their mixtures to at least 5 wt.-% preferably to at least 10 wt.-% and most preferably to at least 15 wt.-% at 70° C.

The water resistant ammonium nitrate fuel oil explosive of the invention is a particulate and not in the form of an emulsion. As used herein, "particulate" ammonium nitrate, "particulate" ANFO and "particulate" LDANFO means material in the form of separate, discrete particles, e.g., prills, granules, pellets and fines, as opposed to cast or powdered ammonium nitrate or solutions or dispersions thereof. Preferred particles are small-sized with an average diameter range preferably between 0.5 and 5 mm, more preferably between 1 and 3 mm and especially between 1.3 and 2.5 mm as for example between 0.5 and 3 mm, between 0.5 and 2.5 mm, between 1 and 5 mm, between 1 and 2.5 mm; between 1.3 and 5 mm or between 1.3 and 3 mm. Porous spheres (prills) which have a low bulk density are especially preferred.

The invention is preferably applied for the treatment of ammonium nitrate with a low bulk density of between 0.60 to 0.90 g/cm$^3$, preferably between 0.70 to 0.85 g/cm$^3$ and most preferably between 0.72 and 0.80 g/cm$^3$ as for example between 0.60 and 0.85 g/cm$^3$, between 0.60 and 0.80 g/cm$^3$, between 0.70 and 0.90 g/cm$^3$, between 0.70 and 0.85 g/cm$^3$, between 0.72 and 0.90 g/cm$^3$ or between 0.72 and 0.85 g/cm$^3$. The bulk density is determined by weighing an untamped sample of the prills in a container of known volume. The particle density of the prills is such that, when liquid fuel is properly applied to and mixed with them, the prills absorb the fuel uniformly which enhances blasting activity. The fuel oil is absorbed onto the surface and into the pores of the ammonium nitrate granules.

Preferred ammonium nitrate grades have a purity of at least 90.0 wt.-%, more preferably between 92.0 and 99.9 wt.-%, more preferably between 95.0 and 99.8 wt.-% and especially between 96.0 and 99.7 wt.-% as for example between 90.0 and 99.9 wt.-%, between 90 and 99.8 wt.-%, between 90 and 99.7 wt.-%, between 92.0 and 99.8 wt.-%, between 92.0 and 99.7 wt.-%, between 95 and 99.9 wt.-%, between 95.0 and 99.7 wt.-% or between 95.0 and 99.8 wt.-%.

Optionally, the ammonium nitrate prills are stabilized to improve their physical properties (i.e., to provide greater hardness and resistance to caking, lower moisture sensitivity and/or breakdown in particle size, that is, "dusting") by providing in the ammonium nitrate melt, prior to prilling, any of the conventional ammonium nitrate stabilizers, such as natural phosphates, potassium metaphosphate, mono- and diammonium phosphate, ammonium sulfate, potassium chloride, magnesium salts, calcium salts, sodium silicate, clays, sodium, calcium and potassium nitrates, iron cyanides, metal oxides (e.g., magnesium oxide), etc. Preferably the amount of stabilizer is less than 10 wt.-% and more preferably between 0.1 and 5.0 wt.-% relative to the amount of ammonium nitrate.

Fuel oils suited for the preparation of ANFO are essentially all liquid hydrocarbons with a boiling range between 100 and 450° C. One preferred kind of hydrocarbons are mineral oil distillates. These may comprise linear, branched or cyclic aliphatic hydrocarbons and mono- di or polycyclic aromatic hydrocarbons and mixtures thereof. The hydrocarbons may be substituted; preferred substituents are $C_1$-$C_{20}$ linear or branched alkyl residues and/or functional groups like hydroxyl and nitro groups. Examples for preferred hydrocarbons are toluene, xylene, naphthalene, decane, dodecane, tetradecane, hexadecane, decaline and their mixtures. Especially preferred are mineral oil distillation cuts including diesel, heating oil, jet fuel (particularly "jet A" fuel), kerosene, lube oil, coal oil, kerogen extract (from shale oil) and the like.

Oily liquids derived from plant and animal origins as well as their synthetic equivalents such as alcohols (e.g. having an alkyl residue with 6 to 18 carbons, or more), glycols, amines, esters and/or ketones may also be used instead of fuel oil. Supplementary fuels of the fatty acid type which are suitable for use in the carbonaceous fuel component include octanoic acid, decanoic acid, lauric acid, palmitic acid, stearic acid, oleic acid, behenic acid and their mixtures. Supplementary fuels of the higher alcohol type which are suitable for use in the carbonaceous fuel component include hexyl alcohol, octyl alcohol, nonyl alcohol, lauryl alcohol, cetyl alcohol, stearyl alcohol and their mixtures.

Further preferred fuels oils are derived from renewable resources (biofuels). Preferred biofuels are esters from fatty acids with 8 to 30 carbon atoms with lower alcohols containing 1 to 6, preferably 1 to 4 and especially 1 to 3 carbon atoms. Preferably the alcohol contains 1 to 6 and especially 1 to 3 hydroxyl groups, e.g. methanol, ethanol, ethylene glycol, propylene glycol and glycerine. Especially preferred are esters of fatty esters and methanol as for example rape methyl ester, cocoa nut methyl ester or soy methyl ester and partial as well as full esters of glycerine with fatty acids.

Similarly suited are synthetic fuels oils which are accessible for example by Fischer-Tropsch synthesis or by hydrodeoxygenation and optionally isomerization of biofuels.

Fuels oils derived from renewable resources, supplementary fuel oils and synthetic fuel oils may be used sole or in a mixture of two or more selected from mineral oils, synthetic and renewable fuels.

Preferred fuel oils have a pour point above −25° C., however, the invention is also applicable to fuel oils having a pour point above −10° C., above 0° C. and even above +10° C. as for example to fuel oils having a pour point between −25 and +30° C., between −20 and +30° C., between −20 and +20° C. or between −25 and +20° C. The pour point can be determined according to DIN ISO 3016.

Preferably the amount of fuel oil added to the ammonium nitrate is between 1 and 20 wt.-%, more preferably between 2 and 15 wt.-% and especially between 4 and 10 wt.-% as for example between 1 and 15 wt.-%, between 1 and 10 wt.-%, between 2 and 20 wt.-%, between 2 and 10 wt.-%, between 4 and 20 wt.-% or between 4 and 15 wt.-% of the ammonium nitrate.

In a preferred embodiment the oil soluble and water insoluble polymers containing linear polymethylene sequences with an average of 10 to 40 consecutive methylene groups are provided to the ammonium nitrate fuel oil explosive by dissolving and/or dispersing the polymer in the fuel oil and applying the fuel oil containing the polymer to the solid ammonium nitrate. Preferably the concentration of the polymer in the fuel oil is between 0.1 and 15 wt.-%, more preferably between 1 and 12 wt.-% and especially between 3 and 10 wt.-% as for example between 0.1 and 12 wt.-%, between 0.1 and 10 wt.-%, between 1 and 15 wt.-%, between 1 and 10 wt.-%, between 3 and 20 wt.-% or between 3 and 15 wt.-%.

According to the state of the art the manufacture of WR-ANFO from ammonium nitrate and fuel oil requires temperatures above the pour point and especially also above the cloud point of the fuel oil. Operating temperatures below the pour point of the fuel oil cause severe handling issues with pumping of the fuel oil, inability to achieve uniform mixing and incomplete penetration of the fuel oil into the porous ammonium nitrate prills. However, the manufacture of ANFO according to the invention may successfully proceed at temperatures below the pour point of the neat fuel oil, e.g. at temperatures frequently 3° C., often 5° C. and sometimes 10° C. below the pour point and/or 5° C., often 10° C. and sometimes 15° C. below the cloud point of the neat fuel oil. Neat fuel refers to the fuel oil component without the incorporation of the oil soluble polymer according to the invention.

In a preferred embodiment the ratio of ammonium nitrate to fuel oil containing the polymer is in the range between 99:1 and 80:20, especially between 98:2 and 90:10 and especially preferred between 93:7 and 95:5 as for example between 99:1 and 90:10, between 99:1 and 95:5, between 98:2 and 80:20, between 98:2 and 95:5, between 93:7 and 80:20 or between 93:7 and 90:10. In a further preferred embodiment 0.05 to 5.0 wt.-% and especially 0.1 to 2.0 wt.-% as for example 0.05 to 2.0 wt.-% or 0.1 to 5.0 wt.-% of the oil soluble polymer per weight unit of ammonium nitrate is applied.

Preferably the water resistant ammonium nitrate fuel oil explosive of the invention contains between 80 and 99 wt.-%, especially between 90 and 98 wt.-% and especially preferred between 93 and 95 wt.-% as for example between 80 and 98 wt.-%, between 80 and 95 wt.-%, between 90 and 99 wt.-%, between 90 and 95 wt.-%, between 93 and 99 wt.-% or between 93 and 98 wt.-% of ammonium nitrate. Typically it contains less than 2 wt.-%, most often less than 1.0 wt.-% and especially less than 0.5% of water.

In one preferred embodiment, the oil soluble and water insoluble polymer containing linear polymethylene sequences with an average 10 to 40 consecutive methylene groups is a copolymer of ethylene and 5 to 18 mol-%, preferably 6 to 16 mol-% and especially 8 to 15 mol-% of at least one vinyl ester, acrylic ester, methacrylic ester, and/or alkyl vinyl ether having a $C_1$ to $C_8$ alkyl or alkenyl group (referred to as copolymer (i)).

In preferred ethylene copolymers the comonomers are statistically distributed. They contain the linear polymethylene sequences in the polymer backbone (main chain polymers). The calculation of the average length of the polymethylene sequence (PS(i)) is based on the molar comonomer fraction of the copolymer with the comonomer contributing one additional methylene group to the polymethylene sequence. The alkyl chains of the comonomer, if present, are not considered in this calculation.

$$PS(i) = \left(\frac{\text{molar content of ethylene}}{\text{molar content of comonomer}}\right) * 2 + 1$$

As comonomers for ethylene copolymers preferred vinyl esters are those of the formula (1)

$$CH_2{=}CH{-}OCOR^1 \quad (1)$$

in which $R^1$ is $C_1$- to $C_8$-alkyl, preferably $C_2$- to $C_7$-alkyl, especially $C_4$- to $C_6$-alkyl as for example $C_1$- to $C_7$-alkyl, $C_1$- to $C_6$-alkyl or $C_1$- to $C_4$-alkyl. The alkyl radicals may be linear or—in case they have 3 or more carbon atoms—branched. In a preferred embodiment, the alkyl radicals are linear alkyl radicals having 1 to 8 carbon atoms. In a further preferred embodiment, $R^1$ is a branched alkyl radical having 3 to 8 carbon atoms and preferably having 3 to 7 carbon atoms. Suitable vinyl esters include vinyl acetate, vinyl propionate, vinyl butyrate, vinyl isobutyrate, vinyl hexanoate, vinyl heptanoate, vinyl octanoate, vinyl 2-ethylhexanoate. An especially preferred vinyl ester is vinyl acetate. In a further embodiment, the alkyl groups mentioned may be substituted by one or more hydroxyl groups.

In a further embodiment, these ethylene copolymers contain vinyl acetate and at least one further vinyl ester of the formula 1 in which $R^1$ is $C_2$- to $C_8$-alkyl, preferably $C_4$- to $C_7$ alkyl. Preferred further vinyl esters are the above-described vinyl esters of this chain length range.

As comonomers for ethylene copolymers preferred acrylic and methacrylic acid esters are those of formula (2)

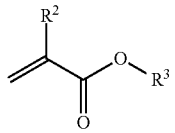

(2)

in which $R^2$ is hydrogen or methyl and $R^3$ is $C_1$- to $C_8$-alkyl, preferably $C_2$- to $C_7$-alkyl, especially $C_4$- to $C_6$-alkyl as for example $C_1$- to $C_7$-alkyl, $C_1$- to $C_6$-alkyl, $C_1$- to $C_4$-alkyl, $C_2$- to $C_8$-alkyl, or $C_4$- to $C_8$-alkyl. The alkyl radicals may be linear, branched or cyclic. In a preferred embodiment, they are linear. In a further preferred embodiment, they possess a branch in the 2 position to the ester moiety.

Suitable acrylic esters include, for example, methyl (meth)acrylate, ethyl (meth)acrylate, propyl (meth)acrylate, n- and isobutyl (meth)acrylate, and hexyl (meth)acrylate, octyl (meth)acrylate, 2-ethylhexyl (meth)acrylate and mixtures of these comonomers, the formulation "(meth)acrylate" including the corresponding esters of acrylic acid and methacrylic acid. Said esters of acrylic acid are especially preferred.

As comonomers for ethylene copolymers preferred alkyl vinyl ethers are preferably compounds of the formula (3)

$$CH_2{=}CH{-}OR^4 \quad (3)$$

in which $R^4$ is $C_1$- to $C_8$-alkyl, preferably $C_2$- to $C_7$-alkyl, especially $C_4$- to $C_6$-alkyl as for example $C_1$- to $C_7$-alkyl, $C_1$- to $C_6$-alkyl or $C_1$- to $C_4$-alkyl. The alkyl radicals may be linear, branched or cyclic. Examples include methyl vinyl ether, ethyl vinyl ether, isobutyl vinyl ether.

The alkyl radicals $R^1$, $R^3$ and $R^4$ may bear minor amounts of functional groups, for example amino, amido, nitro, cyano, hydroxyl, keto, carbonyl, carboxyl, ester and sulfo groups and/or halogen atoms, provided that they do not significantly impair the hydrocarbon character of the radicals mentioned. In a preferred embodiment, the alkyl radicals $R^1$, $R^3$ and $R^4$, however, do not bear any basic groups and especially no nitrogen-containing functional groups.

Particularly preferred terpolymers contain, apart from ethylene, preferably 3.5 to 17 mol-% and especially 5 to 15 mol-% of vinyl acetate, and 0.1 to 10 mol-% and especially 0.2 to 5 mol-% of at least one long-chain vinyl ester, (meth)acrylic ester and/or alkene, where the total comonomer content is between 5 and 18 mol-%, preferably between 6 and 16 mol-% and especially between 8 and 15 mol-%. Particularly preferred termonomers are vinyl 2-ethylhexanoate, vinyl neononanoate and vinyl neodecanoate. Further particularly preferred copolymers contain, in addition to ethylene and 3.5 to 17.5 mol-% and especially 5 to 16 mol-% of vinyl esters, also 0.1 to 10 mol-% and especially 0.2 to 5.0 mol-% of one or more olefins such as propene, butene, isobutene, hexene, 4-methylpentene, octene, diisobutylene, norbornene and/or styrene, the total comonomer content being between 5 and 18 mol-%, preferably between 6 and 16 mol-% and especially between 8 and 15 mol-%.

The number average molecular weight of the ethylene copolymers (i) is preferably between 500 and 100,000 g/mol and especially between 1,000 and 50,000 g/mol as for example between 500 and 50,000 g/mol or between 1,000 and 100,000 g/mol as determined by Gel Permeation Chromatography using poly(styrene) standards. Often the molecular weight of ethylene copolymers (i) is determined in terms of the melt viscosity of the solvent free polymer at elevated temperatures, e. g. at 140° C. ($V_{140}$). The melt viscosity $V_{140}$ of preferred ethylene copolymers (i) is between 20 and 2,000 mPas and especially between 50 and 1,000 mPas, for example between 20 and 1,000 mPas or between 50 and 2,000 mPas. The degrees of branching of polymers (i) determined by means of $^1H$ NMR spectroscopy are preferably between 1 and 9 $CH_3$/100 $CH_2$ groups, especially between 2 and 6 $CH_3$/100 $CH_2$ groups, which do not originate from the comonomers.

In a preferred embodiment mixtures of two or more of the abovementioned ethylene copolymers are used. The polymers on which the mixtures are based more preferably differ in at least one characteristic. For example, they may contain different comonomers, different comonomer contents, different molecular weights and/or different degrees of branching.

The copolymers (i) are prepared by known processes (on this subject, see, for example, Ullmanns Encyclopädie der Technischen Chemie, 5th edition, vol. A 21, pages 305 to 413). Suitable methods are polymerization in solution, in suspension and in the gas phase, and high-pressure bulk polymerization. Preference is given to employing high-pressure bulk polymerization, which is performed at pressures of 50 to 400 MPa, preferably 100 to 300 MPa, and temperatures of 50 to 350° C., preferably 100 to 300° C. The reaction of the comonomers is initiated by free-radical-forming initiators (free-radical chain initiator). This substance class includes, for example, oxygen, hydroperoxides, peroxides and azo compounds, such as cumene hydroperoxide, t-butyl hydroperoxide, dilauroyl peroxide, dibenzoyl peroxide, bis(2-ethyl hexyl)peroxodicarbonate, t-butyl permaleate, t-butyl perbenzoate, dicumyl peroxide, t-butyl cumyl peroxide, di(t-butyl peroxide, 2,2'-azobis(2-methylpropanonitrile), 2,2'-azobis (2-methylbutyronitrile). The initiators are used individually or as a mixture of two or more substances in amounts of 0.01 to 20% by weight, preferably 0.05 to 10% by weight, based on the comonomer mixture.

The desired molecular weight of the copolymers (i), for a given composition of the comonomer mixture, is adjusted by varying the reaction parameters, e.g. of pressure and temperature, and if appropriate by adding moderators. Useful moderators have been found to be hydrogen, saturated or unsaturated hydrocarbons, for example propane and propene, aldehydes, for example propionaldehyde, n-butyraldehyde and isobutyraldehyde, ketones, for example acetone, methyl ethyl ketone, methyl isobutyl ketone and cyclohexanone, or alcohols, for example butanol. Depending on the desired viscosity, the moderators are employed in amounts up to 20% by weight, preferably 0.05 to 10% by weight, based on the comonomer mixture.

In another preferred embodiment, the oil soluble and water insoluble polymer containing linear polymethylene sequences with an average of 10 to 40 consecutive methylene groups is a homo- or copolymer of esters, amides and/or imides of ethylenically unsaturated carboxylic acids (referred to as homo- or copolymer (ii)). Preferred homo- and copolymers (ii) contain linear polymethylene sequences with an average of 11 to 32 and especially 12 to 24 consecutive methylene groups as for example with 10 to 32, 10 to 24, 11 to 40, 11 to 24, 12 to 40 or 12 to 32 consecutive methylene groups. In this group of polymers the linear polymethylene sequences are originating from the alkyl groups of the comonomers and are located in the polymer side chains. In case of side chain polymers the terminating methyl groups of alkyl residues are included in the counting of methylene groups.

For homo- and copolymers (ii) the average length of the polymethylene sequences (PS(ii)) is calculated from the molar average carbon chain length in the alkyl radicals of the monomers according to the formula:

$$PS(ii) = m_1 \cdot \sum_i w_{1i} \cdot n_{1i} + m_2 \cdot \sum_j w_{2j} \cdot n_{2j} + \ldots + m_g \cdot \sum_p w_{gp} \cdot n_{gp}$$

where $m_1, m_2, \ldots m_g$ are the molar fractions of the comonomers in the polymer and the sum of the molar fractions $m_1$ to $m_g=1$, $w_{1i}, w_{2j}, \ldots w_{gp}$ are the proportions by weight of the individual chain lengths i, j, . . . p of the alkyl radicals of the different comonomers 1 to g, and $n_{1i}, n_{2j}, \ldots n_{gp}$ are the chain lengths of the alkyl radicals i, j, . . . p of the comonomers 1 to g.

Preferred homo- and copolymers (ii) contain at least 50 mol-%, preferably 65 to 99 mol-% and especially 80 to 95 mol-% as for example at least 65 mol-%, at least 80 mol-%, 50 to 99 mol-%, 50 to 95 mol-%, 80 to 99 mol-% or 65 to 95 mol-% structural units derived from monomers carrying 1 (or up to two in case of dicarboxylic acid derivatives) alkyl residue(s) with 10 to 40, preferably 11 to 32 and especially 12 to 24 consecutive methylene groups as for example alkyl residues with 10 to 32, 10 to 24, 11 to 40, 11 to 24, 12 to 40 or 12 to 32 consecutive methylene groups. As stated above, for the counting of methylene groups in the alkyl residues the terminal methyl groups are included. In a preferred embodiment homo- and copolymers (ii) do not contain structural units derived from further monomers. Should structural units derived from further comonomers be present, they are disregarded when calculating the parameter PS(ii).

Suitable homo- or copolymers of esters of ethylenically unsaturated carboxylic acids (ii), said esters bearing $C_{10}$-$C_{40}$—, preferably $C_{11}$-$C_{32}$ and especially $C_{12}$ to $C_{24}$ alkyl radicals, are especially those which contain repeat structural elements of the formula (4)

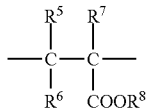

(4)

wherein $R^5$ and $R^6$ are each independently hydrogen, phenyl or a group of the formula $COOR^8$, $R^7$ is hydrogen, methyl or a group of the formula —$CH_2COOR^8$ and $R^8$ is a $C_{10}$- to $C_{40}$-alkyl or-alkenyl radical, preferably a $C_{11}$- to $C_{32}$-alkyl or-alkenyl radical and especially a $C_{12}$ to $C_{24}$-alkyl or alkenyl radical, with the proviso that these repeat structural units contain at least one and at most two carboxylic ester units in one structural element.

Particularly suitable homo- and copolymers are those in which $R^5$ and $R^6$ are each hydrogen and $R^7$ is hydrogen or methyl or in which one of $R^5$ and $R^6$ is hydrogen and the other a group of the formula $COOR^8$ and $R^7$ is hydrogen or in which $R^5$ and $R^6$ are hydrogen and $R^7$ is a group of the formula —$CH_2COOR^8$. These structural units derive from esters of monocarboxylic acids, for example acrylic acid, methacrylic acid, cinnamic acid, or from mono- or diesters of dicarboxylic acids, for example maleic acid, fumaric acid and itaconic acid. Particular preference is given to the esters of acrylic and methacrylic acid.

Preferred alcohols for the esterification of the ethylenically unsaturated mono- and dicarboxylic acids as basis for the repeat structural elements of formula (4) are those alcohols having 10 to 32 consecutive methylene groups, more preferably those having 12 to 26 consecutive methylene groups and especially those having 18 to 24 consecutive methylene groups, terminal methyl groups being included in this counting. They may be of natural or synthetic origin. The alkyl radicals are preferably linear or at least very substantially linear. Suitable fatty alcohols include 1-decanol, 1-dodecanol, 1-tridecanol, isotridecanol, 1-tetradecanol, 1-hexadecanol, 1-octadecanol, eicosanol, docosanol, tetracosanol, hexacosanol and their mixtures. Naturally occurring fatty alcohol mixtures, for example coconut fatty alcohol, tallow fatty alcohol, hydrogenated tallow fatty alcohol and behenyl alcohol are equally suited.

Preferred homo- and copolymers of amides and/or imides of ethylenically unsaturated carboxylic acids (ii) can be obtained by reaction of (co)polymers of ethylenically unsaturated carboxylic acids and/or their anhydrides and/or their esters with lower alcohols with 1 to 4 carbon atoms with amines having one or, in case of amides one or two, alkyl residues with 10 to 40, preferably 11 to 23 and especially 12 to 24 consecutive methylene groups, terminal methyl groups being included in this counting. The alkyl radicals are preferably linear or at least very substantially linear. Suitable amines include 1-decyl amine, 1-dodecyl amine, 1-tridecyl amine, isotridecyl amine, 1-tetradecyl amine, 1-hexadecyl amine, 1-octadecyl amine, eicosyl amine, docosyl amine, tetracosyl amine, hexacosyl amine and their mixtures. Naturally occurring fatty amine mixtures, for example coconut fatty amine, tallow fatty amine, hydrogenated tallow fatty amine and behenyl amine are equally suited. Similarly, suitable homo- and copolymers of amides and/or imides of ethylenically unsaturated carboxylic acids (ii) can be obtained by homo- or copolymerization of amides and/or imides of ethylenically unsaturated carboxylic acids amidated resp. imidated with above mentioned amines having one or, in case of amides one or two, alkyl residues with 10 to 40, preferably 11 to 23 and especially 12 to 24 consecutive methylene groups, terminal methyl groups being included in this counting.

The polymers (ii) may, in addition to the $C_{10}$-$C_{30}$-alkyl esters, amines and/or imides of the unsaturated carboxylic acids, comprise further comonomers such as vinyl esters of the formula (1), short-chain (meth)acrylic esters of the formula (2) in which $R^2$ is hydrogen or methyl and $R^3$ is $C_1$- to $C_9$-alkyl or $>C_{40}$-alkyl, alkyl vinyl ethers of the formula (3) and/or alkenes.

Preferred vinyl esters for use as further comonomer in polymers (ii) correspond to the definition given for formula (1). Particular preference is given to vinyl acetate. Preferred alkenes for use as further comonomer in polymers (ii) are α-olefins, i.e. linear olefins with a terminal double bond, preferably with chain lengths of 12 to 42 and more particularly 13 to 34 and especially 14 to 26, as for example 18 to 24, carbon atoms. Examples of suitable alpha-olefins are 1-dodecene, 1-tridecene, 1-tetradecene, 1-pentadecene, 1-hexadecene, 1-heptadecene, 1-octadecene, 1-nonadecene, 1-eicosene, 1-henicosene, 1-docosene, 1-tetracosene. Likewise suitable are commercially available chain cuts, for example $C_{13-18}$-α-olefins, $C_{12-16}$-α-olefins, $C_{14-16}$-α-olefins, $C_{14-18}$-α-olefins, $C_{16-18}$-α-olefins, $C_{16-20}$-α-olefins, $C_{22-28}$-α-olefins, $C_{30+}$-α-olefins. In a particularly preferred embodiment α-olefins are included in the calculation of the average length of the polymethylene sequence according to formula PS(ii) with the average length of the polymethylene sequences of the ester, amide/imide units and the side chains stemming from the α-olefins being between 10 and 40, preferably between 11 and 32 and especially between 12 and 24. For α-olefins the length of the alkyl residue attached to the double bond is considered for the calculation of PS(ii). Ethylene is not a suitable Comonomer here.

Further monomers suitable as comonomers in polymer (ii) are ethylenically unsaturated compounds bearing functional groups and/or heteroatoms, for example allyl polyglycols, benzyl acrylate, hydroxyethyl acrylate, hydroxypropyl acrylate, hydroxybutyl acrylate, dimethylaminoethyl acrylate, perfluoroalkyl acrylate and the corresponding esters and amides of methacrylic acid, vinylpyridine, vinylpyrrolidone, p-acetoxystyrene and vinyl methoxyacetate. Their proportion in the polymer (ii) is preferably less than 20 mol-%, especially between 1 and 15 mol-%, for example between 2 and 10 mol-%. In a preferred embodiment polymer (ii) does not contain ionomeric functional groups which are capable of protolytic reactions and/or groups capable of forming H bonds.

Allyl polyglycols suitable as comonomers in polymer (ii) may, in a preferred embodiment of the invention, comprise 1 to 50 ethoxy or propoxy units and correspond to the formula (5):

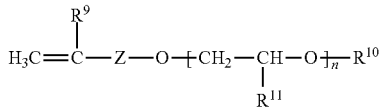

(5)

wherein $R^9$ is hydrogen or methyl,

Z is $C_1$-$C_3$-alkylene, $R^{10}$ is hydrogen, $C_1$-$C_{30}$-alkyl, cycloalkyl, aryl or —C(=O)—$R^{12}$ $R^{11}$ is hydrogen or $C_1$-$C_{20}$-alkyl, $R^{12}$ is $C_1$-$C_{30}$-alkyl, $C_3$-$C_{30}$-alkenyl, cycloalkyl or aryl and n is from 1 to 50, preferably 1 to 30.

Particular preference is given to comonomers of the formula 5 in which $R^9$ and $R^{11}$ are each hydrogen and $R^{10}$ is hydrogen or a $C_1$-$C_4$-alkyl group.

Preferred copolymers (ii) contain at least 10 mol-%, more particularly 20 to 95 mol-%, especially 30 to 80 mol-%, specifically 40 to 60 mol-% as for example 10 to 95 mol-%, 10 to 80 mol-%, 10 to 60 mol-%, 10 to 40 mol-%, 20 to 80 mol-%, 20 to 60 mol-%, 20 to 40 mol-%, 30 to 95 mol-%, 30 to 60 mol-%, 40 to 95 mol-% or 40 to 80 mol-% of structural units derived from esters of ethylenically unsaturated carboxylic acids, said esters bearing alkyl residues with 10 to 40, preferably with 11 to 32 and especially with 12 to 24 consecutive methylene groups, as for example with 10 to $C_{32}$, with $C_{10}$ to $C_{24}$, with 11 to 40, with 11 to 24, with 12 to 40 or with 12 to 32 consecutive methylene groups, including terminal methyl groups.

In a specific embodiment, the polymers (ii) consist solely of structural units derived from esters of ethylenically unsaturated carboxylic acids, said esters bearing $C_{10}$- to $C_{40}$-alkyl radicals, preferably $C_{11}$- to $C_{32}$-alkyl radicals and especially $C_{12}$- to $C_{24}$-alkyl radicals as for example $C_{10}$- to $C_{32}$-alkyl radicals, $C_{10}$ to $C_{24}$-alkyl radicals, $C_{11}$- to $C_{40}$-alkyl radicals, $C_{11}$- to $C_{24}$-alkyl radicals, $C_{12}$- to $C_{40}$-alkyl radicals or $C_{12}$- to $C_{32}$-alkyl radicals.

Preferred homo- or copolymers of esters of ethylenically unsaturated carboxylic acids (ii), said esters bearing $C_{10}$-$C_{40}$-alkyl radicals, preferably $C_{11}$ to $C_{32}$-alkyl radicals and especially $C_{12}$ to $C_{24}$-alkyl radicals, are, for example, poly (alkyl acrylates), poly(alkyl methacrylates), copolymers of alkyl(meth)acrylates with vinylpyridine, copolymers of alkyl(meth)acrylates with allyl polyglycols, esterified copolymers of alkyl(meth)acrylates with maleic anhydride, copolymers of esterified ethylenically unsaturated dicarboxylic acids, for example dialkyl maleates or fumarates, with α-olefins, copolymers of esterified ethylenically unsaturated dicarboxylic acids, for example dialkyl maleates or fumarates, with unsaturated vinyl esters, for example vinyl acetate, or else copolymers of esterified ethylenically unsaturated dicarboxylic acids, for example dialkyl maleates or fumarates, with styrene. In a preferred embodiment, the inventive copolymers (ii) do not contain any comonomers carrying basic groups and more particularly no nitrogen-containing comonomers.

The molecular weights or molar mass distributions of preferred homo- and copolymers (ii) are characterized by a K value (measured according to Fikentscher in 5% solution in toluene) of 10 to 100, preferably 15 to 80. The number average molecular weights Mn may be within a range from 4,000 to 200,000, preferably from 6,000 to 100,000 and especially from 25,000 to 80,000, and are determined, for example, by means of gel permeation chromatography GPC against poly(styrene) standards.

The homo- and copolymers (ii) are prepared typically by (co)polymerizing esters, amides and/or imides of ethylenically unsaturated carboxylic acids, especially alkyl acrylates and/or alkyl methacrylates, optionally with further comonomers, by customary free-radical polymerization methods.

A suitable preparation method for preparing the homo- and copolymers (ii) consists in dissolving the monomers in an organic solvent and polymerizing them in the presence of a free-radical chain initiator at temperatures in the range from 30 to 150° C. Suitable solvents are preferably aromatic hydrocarbons, for example toluene, xylene, trimethylbenzene, dimethylnaphthalene or mixtures of these aromatic hydrocarbons. Commercial mixtures of aromatic hydrocarbons, for example Solvent Naphtha, Shellsol® and Solvesso® grades, also find use. Suitable solvents are likewise aliphatic hydrocarbons.

Alkoxylated aliphatic alcohols or esters thereof, for example butylglycol, also find use as solvents, but preferably as a mixture with aromatic hydrocarbons. In specific cases, a solvent-free polymerization to prepare the cold flow improvers is also possible.

The free-radical initiators used are typically customary initiators such as azobisisobutyronitrile, esters of peroxycarboxylic acids, for example t-butyl perpivalate and t-butyl per-2-ethylhexanoate, or dibenzoyl peroxide.

A further means of preparing the homo- and copolymers (ii) consists in the polymer-analogous esterification or transesterification respectively amidation or aminolysis of already polymerized ethylenically unsaturated carboxylic acids, the esters thereof with short-chain alcohols e.g. with $C_1$- to $C_4$-alcohols, or the reactive equivalents thereof, for example acid anhydrides with fatty alcohols and/or fatty amines having 10 to 40, preferably $C_{11}$ to $C_{32}$-alkyl radicals and especially $C_{12}$ to $C_{24}$-alkyl radicals. For example, the transesterification of poly(meth)acrylic acid with fatty alcohols or the esterification of polymers of maleic anhydride and α-olefins with fatty alcohols leads to polymers (ii) suitable in accordance with the invention.

In another preferred embodiment, the oil soluble and water insoluble polymer containing linear polymethylene sequences with an average of 10 to 40 consecutive methylene groups is a graft polymer wherein a graft layer which comprises ethylenically unsaturated esters is grafted onto a graft base that is an ethylene copolymer (referred to as polymer (iii)).

A graft polymer (iii) based on an ethylene copolymer as graft base is considered to be an ethylene copolymer for the purpose of calculation of the average length of the linear polymethylene group sequence. Therefore the limits for the calculation of PS(i) have to be fulfilled, based on the comonomer content of the ethylene copolymer.

In a preferred embodiment it proved to be advantageous that the limits for the calculation of both PS(i) for the graft base and PS(ii) for the graft layer are fulfilled.

Preferred graft copolymers (iii) are, for example, those which a) as graft base, comprise an ethylene copolymer which, in addition to ethylene, contains 5 to 18 mol-% preferably 6 to 16 mol-% and especially 8 to 15 mol-% of at least one vinyl ester, acrylic ester, methacrylic ester, alkyl vinyl ether and/or alkene, onto which b) as graft layer, a homo- or copolymer of an ester of an α,β-unsaturated carboxylic acid with a $C_{10}$- to $C_{40}$-alcohol has been grafted.

The vinyl ester, acrylic ester, methacrylic ester, alkyl vinyl ether and/or alkene that are the comonomers of graft base a) are those as described for copolymer (i) of this invention. Except for the molecular weight, the graft base a) will satisfy all limitations as described for copolymer (i) of this invention. Preferably the ethylene copolymers used as graft base have for (iii) have higher molecular weights than those used for (i). Such molecular weights are often determined via the melt flow index MFI(190/2, 16) according to DIN ISO EN 1133-1 at 190° C. and an applied load of 2.16 kg. Preferred ethylene copolymers as graft base for (iii) have MFI(190/2, 16) values between 1 and 1,200 g/10 min and especially between 10 and 900 g/min as for example between 1 and 900 g/10 min or between 10 and 1,200 g/10 min. The degrees of branching determined by means of $^1H$ NMR spectroscopy are preferably between 1 and 9 $CH_3$/100 $CH_2$ groups, especially between 2 and 6 $CH_3$/100 $CH_2$ groups, which do not originate from the comonomers.

The (co)polymers b) grafted onto the ethylene copolymers a) contain preferably 40 to 100% by weight and especially 50 to 90% by weight of one or more structural units derived from alkyl acrylates and/or alkyl methacrylates. Preferably at least 10 mol-%, more particularly 20 to 100 mol-%, especially 30 to 90 mol-%, for example 40 to 70 mol-%, as for example 20 to 90 mol-%, 20 to 70 mol-%, 30 to 100 mol-%, 30 to 70 mol-%, 40 to 100 mol-% or 40 to 90 mol-% of the grafted structural units bear alkyl radicals having at least 10 and more preferably at least 11 and especially at least 12 carbon atoms.

Particularly preferred monomers for grafting are alkyl (meth)acrylates having $C_{10}$-$C_{40}$-alkyl radicals, preferably $C_{11}$-$C_{32}$-alkyl radicals and especially $C_{12}$-$C_{24}$-alkyl radicals as for example $C_{10}$- to $C_{32}$-alkyl radicals, $C_{10}$ to $C_{24}$-alkyl radicals, $C_{11}$- to $C_{40}$-alkyl radicals, $C_{11}$- to $C_{24}$-alkyl radicals, $C_{12}$- to $C_{40}$-alkyl radicals or $C_{12}$- to $C_{32}$-alkyl radicals (including the terminal methyl group of the alkyl residue).

The grafted polymers b) optionally contain 0 to 60% by weight, preferably 10 to 50% by weight, for example 10 to 60% by weight or 0 to 50% by weight of one or more further structural units which derive from further ethylenically unsaturated compounds. Suitable further ethylenically unsaturated compounds are, for example, vinyl esters of carboxylic acids having 1 to 20 carbon atoms, α-olefins having 6 to 40 carbon atoms, vinylaromatics, dicarboxylic acids and anhydrides and esters thereof with $C_{10}$-$C_{30}$-fatty alcohols, acrylic acid, methacrylic acid and especially ethylenically unsaturated compounds bearing further functional groups and/or heteroatoms, for example benzyl acrylate, hydroxyethyl acrylate, hydroxypropyl acrylate, hydroxybutyl acrylate, p-acetoxystyrene, vinyl methoxyacetate, dimethylaminoethyl acrylate, perfluoroalkyl acrylate, the isomers of vinylpyridine and derivatives thereof, N-vinylpyrrolidone and (meth)acrylamide and derivatives thereof, such as N-alky] (meth)acrylamides with $C_1$-$C_{20}$-alkyl radicals. Also suitable as further ethylenically unsaturated compounds are allyl polyglycols of the formula (5).

The graft polymers (iii) preferably contain ethylene copolymer a) and homo- or copolymer of an ester of an α,β-unsaturated carboxylic acid with a $C_{10}$- to $C_{40}$-alcohol b) in a weight ratio of 1:10 to 10:1, preferably of 1:8 to 5:1, more preferred of 1:5 to 1:1, as for example in a weight ratio of 1:10 to 5:1, 1:10 to 1:1, 1:8 to 10:1, 1:8 to 1:1, 1:5 to 10:1 or 1:5 to 5:1.

The number average molecular weights Mn of preferred graft polymers (iii) may be within a range from 4,000 to 200,000 g/mol, preferably from 6,000 to 100,000 g/mol and especially from 10,000 to 80,000 g/mol as for example from 4,000 to 100,000 g/mol, from 4,000 to 8,000 g/mol, from 6,000 to 200,000 g/mol, from 6,000 to 80,000 g/mol, from 10,000 to 200,000 g/mol or from 10,000 to 100,000 g/mol, and are determined, for example, by means of gel permeation chromatography GPC against poly(styrene) standards.

Graft polymers (iii) are prepared by known methods. For example, the graft polymers (iii) are obtainable by mixing ethylene copolymer a) and comonomer or comonomer mixture b), optionally in the presence of an organic solvent, and adding a free-radical chain initiator.

The manufacture of water resistant ammonium nitrate fuel oil explosives (WR-ANFO) according to the third aspect of the invention comprises bringing a particulate ammonium nitrate into contact with a fuel oil, the fuel oil being the solution and/or dispersion of an oil soluble polymer comprising linear polymethylene sequences with an average of 10 to 40 consecutive methylene groups. In a preferred embodiment the WR-ANFO is formed by charging dry, free-flowing ammonium nitrate prills to a mixing appliance, for example a planetary mixer, ribbon blender or cement mixer to which then the liquid mixture containing the fuel oil and the oil soluble polymer are added. The addition of the liquid mixture may happen at once or, preferably, over a longer time span of e.g. 2 minutes, preferably between 5 minutes and 5 hours and especially between 10 minutes and 2 hours as for example between 5 minutes and 2 hours or between 10 minutes and 5 hours. By mixing dry, free-flowing WR-ANFO prills are formed.

The oil soluble polymers (i), (ii) and (iii) can be applied to the fuel oil as such, i.e. solvent free. However, due to their viscosity a concentrate of the polymers in hydrocarbons has proven to facilitate their handling. Accordingly, concentrates containing 20 to 90 wt.-%, preferably 30 to 80 wt.-% and especially 40 to 75 wt.-% as for example 20 to 80 wt.-%, 20 to 75 wt.-%, 30 to 90 wt.-%, 30 to 75 wt.-%, 40 to 80 wt.-% or 40 to 90 wt.-% of the polymer in a suitable solvent are preferably used for the manufacture of the WR-ANFO. Hydrocarbons with a boiling range between 100 and 450° C. have been successfully applied as solvent for such concentrates.

In a further preferred embodiment the oil soluble polymers (i), (ii) and (iii) are applied to the fuel oil as a dispersion in water or in mixtures of water with polar organic solvents like monoethylene glycol, diethylene glycol, glycerine and the like.

In a preferred embodiment the WR-ANFO according to the invention is substantially free of water, i.e. it contains less than 2 wt.-%, most often less than 1.0 wt.-% and especially less than 0.5% water.

By incorporation of the above described oil soluble polymers into the fuel oil used for the manufacture of LDANFO the resistance of LDANFO towards water is increased. This ensures unchanged blasting efficiency of the LDANFO even in moist environments and improves the reliability of the blasting process. Furthermore, the protection against water damage improves the completeness of detonation. An ideal detonation of ANFO will generate carbon dioxide, nitrogen gas and water vapour. Degradation of ANFO caused by water can result in the generation of post blast fume which consists of oxides of nitrogen (NOx) which are toxic and environmental pollutants. By protecting the ANFO from water degradation, the above described polymers will reduce the generation of NOx gases.

Additionally the process for manufacture of the WR-ANFO according to the invention allows the use of heavier and cheaper fuel oil grades with inferior cold flow properties respectively the manufacture of WR-ANFO with a given fuel oil at lower temperatures which improves safety and energy consumption of the manufacturing process.

In this specification, percentages are weight percentages unless otherwise noted.

EXAMPLES

Water Resistance Tests

In these examples, the water resistance is determined as the mass portion remaining after a sample of ANFO has been exposed to a water saturated substrate for 24, 48 respectively 72 hours. In the water resistance test, ANFO samples are prepared using the LDAN/Fuel ratio given in Table 4 (weight-%). The oil soluble polymers, if present, are part of the fuel component.

For testing water absorbent sponges are placed in trays of water so that the bottom half of the sponges are immersed keeping the entire surface of each sponge damp. A paper towel is laid over the sponges to give a uniform surface. The paper towel is kept saturated with water by the sponges below. 10.0 g samples of ANFO are weighed into cylindrical molds sitting on temporary plastic sleeves. The molds are then placed on the saturated paper towel and the temporary bottom sleeve is removed exposing the ANFO to the damp surface. After 24, 48 respectively 72 hours storage at ambient temperature the remaining amount of ANFO is reweighed and the loss of ANFO calculated as the weight loss.

TABLE 1

Characterization of the low density ammonium nitrate (LDAN) used:

| | |
|---|---|
| Ammonium nitrate content | 99.5 wt.-% |
| Water content | 0.15 wt.-% |
| pH (5%) solution | 5.0 |
| Oil retention | >10 wt.-% |
| Bulk Density | 0.75 g/cm$^3$ |

TABLE 2

Characterization of fuel oils used for the preparation of ANFO samples

| | FO (I) | FO (II) |
|---|---|---|
| Type | Diesel | Heavy Fuel Oil |
| Cloud Point (EN 23015) | −15° C. | +23° C. |
| Pour Point (DIN ISO 3016) | −19° C. | +18° C. |
| Viscosity | 4 cSt at 40° C. | 650 mm$^2$/s at 50° C. |
| Density (15° C.) | 0.845 | 0.860 |
| Water content | 0.006 wt.-% | 0.008 wt.-% |

TABLE 3

Characterization of the polymers

| Polymer | Characterization | (PS)* |
|---|---|---|
| P1 | Copolymer of stearyl acrylate and 5% allyl polyglycol, 50% active in xylene. The K-value determined according to Fikentscher in 5% solution on toluene was 31. | 18.0 |
| P2 | Ethylene-vinyl acetate copolymer (11 mol-% vinyl acetate, an MFI(190/2, 16) of 7 g/10 minutes) grafted with behenyl acrylate comprising as main components 6 mol-% $C_{18}$-, 18 mol-% $C_{20}$-, 74 mol-% $C_{22}$- and 1 mol-% $C_{24}$-acrylate in a weight ratio of 4:1 as a 25% active mixture in Solvesso 200, | (i) = 17.2<br>(ii) = 21.2 |
| P3 | Ethylene-vinyl acetate copolymer (11 mol-% vinyl acetate, an MFI(190/2, 16) of 7 g/10 minutes) grafted with behenyl acrylate comprising as main components 4 mol-% $C_{18}$-, 51 mol-% $C_{20}$-, 26 mol-% $C_{22}$-, 14 mol-% $C_{24}$- and 4 mol-% $C_{26}$-acrylate in a weight ratio of 4:1, 35% active in Solvesso ® 100 | (i) = 17.2<br>(ii) = 21.0 |
| P4 | Copolymer of maleic anhydride and $C_{20}$-$C_{24}$ α-olefin (comprising 2 mol-% $C_{18}$, 44 mol-% $C_{20}$, 34 mol-% $C_{22}$, 17 mol-% $C_{24}$, 1 mol-% $C_{26}$) which had been esterified with behenyl alcohol comprising as main components 6 mol-% $C_{18}$-, 18 mol-% $C_{20}$-, 74 mol-% $C_{22}$- and 1 mol-% $C_{24}$-alcohol, as a 20 wt.-% active in Shellsol ® AB. | 21.1 |
| P5 | Ethylene-vinyl acetate copolymer (8 mol-% vinyl acetate, an MFI(190/2, 16) of 500 g/10 minutes) grafted with a mixture of alkyl acrylates comprising as main components 35 mol-% $C_{18}$-, 33 mol-% $C_{20}$-, 18 mol-% $C_{22}$-, 10 mol-% $C_{24}$- and 2 mol-% $C_{26}$-acrylate in a weight ratio of 3:1, 35% active in Solvesso ® 100. | (i) = 24.0<br>(ii) = 19.8 |

TABLE 3-continued

| Characterization of the polymers | | |
|---|---|---|
| Polymer | Characterization | (PS)* |
| P6 | Ethylene-vinyl acetate copolymer (11 mol-% vinyl acetate, $V_{140}$ of 250 mPas, 50% active in kerosene | 17.2 |
| P7 (comp.) | Copolymer of ethylene and propylene with an ethylene content of 68% and a Mw of 6000 g/mol as determined by GPC using poly(styrene) standards. | n.a. |
| P8 | Ethylene-vinyl acetate copolymer (8 mol-% vinyl acetate, $V_{140}$ of 600 mPas, 50% active in kerosene | 24.0 |
| P9 | Ethylene-vinyl acetate copolymer (6 mol-% vinyl acetate, $V_{140}$ of 500 mPas, 50% active in kerosene | 32.3 |
| P10 (comp.) | Ethylene-vinyl acetate copolymer (20 mol-% vinyl acetate, $V_{140}$ of 3500 mPas, 40% active in kerosene | 9.0 |
| P11 (comp.) | Ethylene-vinyl acetate copolymer (4 mol-% vinyl acetate, MFI(190/2, 16) of 135 g/10 min; 20% active in decaline | 49.0 |
| P12 (comp.) | Poly(methylacrylate) with a Mn 12,000 g/mol determined by GPC using polystyrene standards, 30% active in acetone | 1 |
| P13 (comp.) | Poly(isobutylene) with a Mn of 600,000 g/mol as determined by GPC using polystyrene standards (corresponding to a Mv of approx. 1,200,000) | n.a. |

*PS = average length of linear polymethylene sequence;
n.a. = not applicable
All polymers used were essentially water free, i.e. they contained less than 100 ppm (wt/wt) of water.

Preparation of ANFO

Samples of ANFO, each about 2 kilograms, were prepared from low density ammonium nitrate (AN) miniprills characterized in table 1 and the fuel characterized in table 2 containing the polymers characterized in table 3 in the amounts given in table 4. The polymers were dissolved in the fuel oil in the concentrations given in table 4. The ANFO samples were formed by charging the dry, free-flowing ammonium nitrate miniprills to a planetary mixer to which was then added the liquid mixture containing the fuel oil containing the oil soluble polymer in order to form dry, free-flowing ANFO miniprills having the compositions set forth in Table 4 below.

The improvement of water resistance was rated according to the scale Excellent>Very Good>Good>Fair>Poor Detonation Tests In further examples, the water resistance is determined by the success of detonation as measured by Velocity of Detonation (VOD) after ANFO has been exposed to a water saturated sand for 24 hours. For the detonation test, ANFO samples are prepared using a LDAN/Fuel ratio of 94:6 (by weight-%) using fuel oil (I) as described above in the water resistance section. The oil soluble polymers, if present, are part of the fuel component.

For testing, a 90 mm diameter cylinder with a height of 500 mm was formed from fly-wire mesh having a mesh size of approximately 1 mm. A 20 mm wide strip of PVC with 8 VOD cables mounted in holes drilled at 30 mm intervals was attached vertically to the side of the fly-wire. The fly-wire mesh cylinder was placed in the centre of a 30 litre plastic bucket. A length of 90 mm PVC pipe was placed

TABLE 4

| Water resistance (WR) of ANFO | | | | | | | | |
|---|---|---|---|---|---|---|---|---|
| | | | wt.-% of | Ratio | wt.-% ANFO remaining after | | | |
| Example | Polymer | FO type | polymer in FO | LDAN:FO | 24 hours | 48 hours | 72 hours | WR rating |
| 1 | blank | FO (I) | 0 | 94:6 | 5 | 2 | 1 | Very poor |
| 2 | blank | FO (II) | 0 | 94:6 | 6 | 3 | 1 | Very poor |
| 3 | P1 | FO (I) | 10 | 94:6 | 90 | 86 | 82 | Very good |
| 4 | P2 | FO (I) | 10 | 94:6 | 88 | 72 | 60 | Good |
| 5 | P3 | FO (I) | 10 | 94:6 | 96 | 91 | 86 | Very good |
| 6 | P4 | FO (I) | 10 | 94:6 | 86 | 70 | 58 | Good |
| 7 | P5 | FO (I) | 10 | 94:6 | 89 | 75 | 64 | Good |
| 8 | P6 | FO (I) | 5 | 94:6 | 95 | 81 | 56 | Good |
| 9 | P6 | FO (I) | 10 | 94:6 | 97 | 93 | 90 | Excellent |
| 10 | P6 | FO (II) | 10 | 94:6 | 97 | 94 | 92 | Excellent |
| 11 | P6 | FO (I) | 10 | 92:8 | 98 | 96 | 93 | Excellent |
| 13 | P6 | FO (I) | 10 | 96:4 | 95 | 92 | 89 | Excellent |
| 14 | P8 | FO (I) | 10 | 94:6 | 95 | 91 | 85 | Very good |
| 15 | P8 | FO (II) | 3 | 92:8 | 96 | 92 | 76 | Excellent |
| 16 | P9 | FO (I) | 10 | 94:6 | 93 | 88 | 81 | Very good |
| 17 | P9 | FO (II) | 15 | 96:4 | 98 | 95 | 93 | Excellent |
| 18 (comp.) | P7 | FO (I) | 10 | 94:6 | 62 | 38 | 30 | Fair |
| 19 (comp.) | P10 | FO(I) | 10 | 94:6 | 65 | 42 | 36 | Fair |
| 20 (comp.) | P 11 | FO (I) | 10 | 94:6 | 28 | 19 | 11 | Poor |
| 21 (comp.) | P 12 | FO (I) | 10 | 94:6 | 38 | 29 | 21 | Poor |
| 22 (comp.) | P 13 | FO (I) | 10 | 94:6 | 36 | 27 | 16 | Poor |

inside the mesh to provide temporary support while the mesh was surrounded by 35 kg of washed Sydney sand which was saturated with 5 litres of water. A standard mass of 2.5 kg of ANFO was then poured inside the centre pipe after which the PVC pipe was removed thereby exposing the ANFO to the wet sand via the mesh. The ANFO was left exposed to the wet sand for 24 hours. After 24 hours 150 g of a Pentolite 50/50 cast booster was placed in the ANFO with the top of the initiator level with the top of the column of ANFO. The ANFO was then detonated and the VOD measured. A velocity of detonation (VOD) of at least 2400 metres per second indicates a successful detonation. The tests were made in duplicate.

TABLE 5

Results of detonation tests

| Example | Polymer | wt.-% of polymer in FO | Ratio LDAN:FO | VOD [m/s] |
|---|---|---|---|---|
| 23 (comp.) | none | 0 | 94:6 | failed to detonate |
| 24 (comp.) | none | 0 | 94:6 | failed to detonate |
| 25 | P1 | 8 | 94:6 | 3150 |
| 26 | P1 | 8 | 94:6 | 3100 |
| 27 | P4 | 12 | 94:6 | 2750 |
| 28 | P4 | 12 | 94:6 | 2850 |
| 29 | P6 | 10 | 94:6 | 3200 |
| 30 | P6 | 10 | 94:6 | 3350 |

The invention claimed is:

1. A process for improving the water resistance of a particulate ammonium nitrate fuel oil explosive, comprising the step of adding a fuel oil containing at least one oil soluble polymer, to an explosive composition comprising at least one particulate ammonium nitrate, wherein the particulate ammonium nitrate fuel oil explosive is not in the form of an emulsion and comprises less than 2 wt.-% of water, and the at least one oil soluble polymer is a copolymer (i) of ethylene and at least one vinyl ester, acrylic ester, methacrylic ester, and/or alkyl vinyl ether, wherein the copolymer (i) has linear polymethylene sequences with an average length PS(i) of 12 to 40 consecutive methylene groups, the average length PS(i) being calculated according to the formula $$PS(i) = \left(\frac{\text{molar content of ethylene}}{\text{molar content of comonomer}}\right) * 2 + 1$$

or a homo- or co-polymer (ii) of esters, amides, and/or imides of ethylenically unsaturated carboxylic acids, wherein the homo- or co-polymer (ii) has linear polymethylene sequences with an average length PS(ii) of 12 to 40 consecutive methylene groups, the average length PS(ii) being calculated according to the formula $$PS(ii) = m_1 \cdot \sum_i w_{1i} \cdot n_{1i} + m_2 \cdot \sum_j w_{2j} \cdot n_{2j} + \ldots + m_g \cdot \sum_p w_{gp} \cdot n_{gp}$$

wherein $m_1, m_2, \ldots m_g$ are the molar fractions of the comonomers in the polymer and the sum of the molar fractions $m_1$ to $m_g=1$, $w_{1i}, w_{2j}, \ldots w_{gp}$ are the proportions by weight of the individual chain lengths i, j, . . . p of the alkyl radicals of the different comonomers 1 to g, and $n_{1i}, n_{2j}, \ldots n_{gp}$ are the chain lengths i, j, . . . p of the alkyl radicals of the comonomers 1 to g, wherein terminating methyl groups of alkyl residues are included in the chain lengths of the alkyl residues; and wherein an amount of the at least one oil soluble polymer added to the explosive composition is 0.05 to 5.0 wt.-% of the weight of the at least one particulate ammonium nitrate in the explosive composition.

2. The process according to claim 1, wherein the at least one oil soluble polymer is a copolymer(i) of ethylene and at least one vinyl ester, acrylic ester, methacrylic ester and/or alkyl vinyl ether, wherein the copolymer (i) comprises 5 to 11 mol-% of the at least one vinyl ester, acrylic ester, methacrylic ester, and/or alkyl vinyl ether.

3. The process according to claim 2, wherein the at least one vinyl ester, acrylic ester, methacrylic ester, and/or alkyl vinyl ether has a $C_1$ to $C_8$ alkyl or alkenyl group.

4. The process according to claim 2, wherein the at least one oil soluble polymer is a copolymer (i) of ethylene and at least one vinyl ester according to formula (1)

$$CH_2{=}CH{-}OCOR^1 \quad (1)$$

in which $R^1$ is a $C_1$- to $C_8$-alkyl.

5. The process according to claim 2, wherein the at least one oil soluble polymer is a copolymer (i) of ethylene and at least one vinyl ester selected from the group consisting of vinyl acetate, vinyl propionate, vinyl butyrate, vinyl isobutyrate, vinyl hexanoate, vinyl heptanoate, vinyl octanoate, and vinyl 2-ethylhexanoate.

6. The process according to claim 2, wherein the at least one oil soluble polymer is a copolymer (i) of ethylene and at least one vinyl ether corresponding to formula (3)

$$CH_2{=}CH{-}OR^4 \quad (3)$$

in which $R^4$ is a $C_1$ to $C_8$-alkyl.

7. The process according to claim 2, wherein the at least one oil soluble polymer is a copolymer (i) of ethylene and at least one ester of an ethylenically unsaturated monocarboxylic acid corresponding to formula (2)

(2)

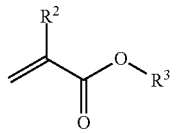

in which $R^2$ is hydrogen or methyl and $R^3$ is a $C_1$- to $C_8$-alkyl.

8. The process according to claim 2, wherein the at least one oil soluble polymer is a copolymer (i) of ethylene and at least one acrylic ester or methacrylic ester selected from the group consisting of methyl (meth)acrylate, ethyl (meth) acrylate, propyl (meth)acrylate, n and isobutyl (meth)acrylate, and hexyl (meth)acrylate, octyl (meth)acrylate, 2 ethylhexyl (meth)acrylate and mixtures of these comonomers, the formulation "(meth)acrylate" including the respective esters of acrylic acid and methacrylic acid.

9. The process according to claim 1, wherein the at least one oil soluble polymer is a homo- or co-polymer (ii) of esters, amides, and/or imides of ethylenically unsaturated carboxylic acids, wherein the esters, amides, and/or imides have alkyl residues with an average alkyl chain length of $C_{10}$-$C_{40}$.

10. The process according to claim 9, wherein the at least one oil soluble polymer is a homo- or co-polymer (ii) of esters of ethylenically unsaturated carboxylic acids, wherein the homo- or co-polymer (ii) repeat structural units of formula (4)

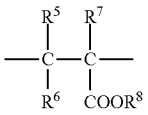

(4)

wherein $R^5$ and $R^6$ are each independently hydrogen, phenyl or a group of the formula $COOR^8$, $R^7$ is hydrogen, methyl or a group of the formula $—CH_2COOR^8$ and $R^8$ is a $C_{10}$- to $C_{40}$-alkyl radical, with the proviso that at most, one of $R^5$ and $R^6$ and $R^7$ include a carboxylic ester group $COOR^8$.

11. The process according to claim 10, wherein the ethylenically unsaturated carboxylic acid esters are esters of ethylenically unsaturated carboxylic acids selected from the group consisting of acrylic acid, methacrylic acid, cinnamic acid, maleic acid, fumaric acid and itaconic acid.

12. The process according to claim 10, wherein $R^8$ has 11 to 32 consecutive methylene groups.

13. The process according to claim 9, wherein the ethylenically unsaturated carboxylic acid esters are esters of alcohols, wherein the alcohol is selected from the group consisting of 1-decanol, 1-dodecanol, 1 tridecanol, isotridecanol, 1 tetradecanol, 1 hexadecanol, 1-octadecanol, eicosanol, docosanol, tetracosanol, hexacosanol and their mixtures.

14. The process according to claim 9, wherein the homo- or copolymers (ii) are homo- or copolymers of amides and/or imides of ethylenically unsaturated carboxylic acids and are obtained by reaction of homo- and copolymers of ethylenically unsaturated carboxylic acids, their anhydrides, and/or their esters with lower alcohols with 1 to 4 carbon atoms, with amines having one or, in case of amides one or two, alkyl residues with 10 to 40 consecutive methylene groups.

15. The process according to claim 14, wherein the amines are selected from the group consisting of 1-decyl amine, 1-dodecyl amine, 1 tridecyl amine, isotridecyl amine, 1 tetradecyl amine, 1-hexadecyl amine, 1 octadecyl amine, eicosyl amine, docosyl amine, tetracosyl amine, hexacosyl amine and their mixtures.

16. The process according to claim 9, wherein the at least one oil soluble polymer is a copolymer (ii) containing 10 to 95 mol % of structural units derived from esters of ethylenically unsaturated carboxylic acids.

17. The process according to claim 9, wherein the at least one oil soluble polymer is a homopolymer (ii) consisting solely of structural units derived from the ester of an ethylenically unsaturated carboxylic acids, wherein the ester contains $C_{10}$-$C_{40}$-alkyl radicals.

18. The process according to claim 10, wherein $R^5$ and $R^6$ are each hydrogen and $R^7$ is hydrogen or methyl.

19. The process according to claim 10, wherein one of $R^5$ and $R^6$ is hydrogen and the other a group of the formula $COOR^8$ and $R^7$ is hydrogen, or wherein $R^5$ and R6 are hydrogen and $R^7$ is a group of the formula

—CH2COOR$^8$.

20. The process according to claim 1, wherein the at least one oil soluble polymer comprising at least one linear polymethylene sequence with an average of 10 to 40 consecutive methylene groups is a graft polymer (iii) of homo- and copolymers b) of esters, amides and/or imides of ethylenically unsaturated carboxylic acids, said esters, amides and/or imides bearing alkyl radicals with an average alkyl chain length of $C_{10}$-$C_{40}$ on copolymers a) of ethylene with 5 to 18 mol-% of at least one monomer selected from vinyl esters, esters of ethylenically unsaturated carboxylic acids and vinyl ethers having a $C_1$ to $C_8$ alkyl or alkenyl group.

21. The process according to claim 20, wherein the graft polymer (iii) contains ethylene copolymer a) and a homo-or copolymer of an ester of an α,β-unsaturated carboxylic acid with a $C_{10}$- to $C_{40}$-alcohol b) in a weight ratio of 1:10 to 10:1.

22. The process according to claim 2, wherein a number average molecular weight of the copolymer (i) is between 500 and 100,-000 g/mol, as determined by Gel Permeation Chromatography using poly(styrene) standards.

23. The process according to claim 9, wherein a number average molecular weight of the homo- or copolymer (ii) is within a range from 4000 to 200,-000 g/mol, as determined by means of Gel Permeation Chromatography against poly (styrene) standards.

24. The process according to claim 1, wherein the explosive composition comprises at least one ammonium nitrate with a bulk density of between 0.6 and 0.9 g/cm$^3$.

25. The process according to claim 1, wherein the explosive composition comprises particulate ammonium nitrate particles with an average diameter of between 0.5 and 5 mm.

26. The process according to claim 1, wherein the at least one particulate ammonium nitrate contains at least 90 wt.-% of ammonium nitrate.

27. The process according to claim 1, wherein the fuel oil is selected from the group consisting of mineral oil distillates, biofuels, synthetic fuel oils and oily liquids derived from plant and animal origin and their synthetic equivalents.

28. The process according to claim 1, wherein the fuel oil has a pour point above −20° C.

29. The process according to claim 1, wherein the fuel oil has a pour point below +30° C.

30. The process according to claim 1, wherein the amount of the at least one oil soluble polymer added to the explosive composition is 0.1 to 5.0 wt.-% of the weight of the at least one particulate ammonium nitrate in the explosive composition.

31. The process according to claim 1, wherein at least 50 wt.-% of solid ANFO is recovered after 24 hours of exposure of solid ANFO to a water saturated substrate, a water saturated substrate being defined as a system wherein a water absorbent sponge is placed in a tray of water so that the bottom half of the sponge is immersed keeping the entire surface of the sponge damp and a paper towel is laid over the sponge to give a uniform surface and the paper towel is kept saturated with water by the sponge below.

32. The process according to claim 1, wherein the particulate ammonium nitrate fuel oil explosive is in the form of free flowing solid particles.

33. The process according to claim 1, wherein the at least one oil soluble polymer is added to the explosive composition in the form of a solution and/or dispersion of the at least ne oil soluble polymer in the fuel oil.

* * * * *